US010655415B2

(12) United States Patent
Castillo et al.

(10) Patent No.: US 10,655,415 B2
(45) Date of Patent: May 19, 2020

(54) MULTIMODAL TOOL JAR

(71) Applicant: BAKER HUGHES INCORPORATED, Houston, TX (US)

(72) Inventors: Homero C. Castillo, Kingwood, TX (US); Otto N. Fanini, Houston, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 900 days.

(21) Appl. No.: 14/730,203

(22) Filed: Jun. 3, 2015

(65) Prior Publication Data

US 2016/0356111 A1 Dec. 8, 2016

(51) Int. Cl.
*E21B 31/107* (2006.01)
*E21B 31/113* (2006.01)

(52) U.S. Cl.
CPC ..... *E21B 31/1135* (2013.01); *E21B 31/107* (2013.01)

(58) Field of Classification Search
CPC ..... E21B 31/107
See application file for complete search history.

(56) References Cited

U.S. PATENT DOCUMENTS 1,671,489 A * 5/1928 Scanlon ..... E21B 31/107 175/306
3,139,933 A * 7/1964 Golden ..... E21B 4/10 173/203
4,037,662 A * 7/1977 Bowling ..... E21B 19/22 166/311
4,105,082 A 8/1978 Cheek
4,566,546 A 1/1986 Evans
4,694,913 A 9/1987 McDonald et al.
(Continued)

FOREIGN PATENT DOCUMENTS

GB 2261238 A 12/1993
GB 2501987 A 11/2013

OTHER PUBLICATIONS

Mercado, Jose L., "Planning for Successful Jarring Operations—Effective Use of Drilling Impact System Helps Release Stuck Pipe," SPE 163413 (Mar. 2013).
(Continued)

*Primary Examiner* — Shane Bomar
*Assistant Examiner* — Steven A MacDonald
(74) *Attorney, Agent, or Firm* — Mossman, Kumar & Tyler PC

(57) ABSTRACT

Methods and apparatus for alleviating a stuck condition of a tool string, including using a jarring assembly to collide a plurality of impact surfaces together. The collision results in at least a shock wave inducing i) translational motion along the longitudinal axis of the tool string, and ii) motion in at least one other degree of freedom sufficient to alleviate the stuck condition of the tool string, which may be at least one of: i) translational motion along an axis substantially normal to the longitudinal axis, and ii) rotational motion. Methods may include generating at least one test impact load using a jarring assembly; generating movement information from a sensor responsive to the at least one test impact load; and generating further impact loads using the jarring assembly in dependence upon the movement information.

23 Claims, 7 Drawing Sheets

(56) References Cited

U.S. PATENT DOCUMENTS

| | | | | |
|---|---|---|---|---|
| 5,086,853 | A | 2/1992 | Evans | |
| 5,156,211 | A | 10/1992 | Wyatt | |
| 5,447,196 | A | 9/1995 | Roberts | |
| 5,669,458 | A * | 9/1997 | Anders | E21B 31/107 166/178 |
| 5,875,842 | A | 3/1999 | Wyatt | |
| 5,931,242 | A | 8/1999 | Oettli | |
| 6,070,672 | A | 6/2000 | Gazda | |
| 6,176,323 | B1 * | 1/2001 | Weirich | E21B 21/08 175/40 |
| 6,290,004 | B1 | 9/2001 | Evans | |
| 6,988,551 | B2 | 1/2006 | Evans | |
| 7,874,364 | B2 | 1/2011 | Redlinger et al. | |
| 8,453,727 | B2 | 6/2013 | Xu | |
| 8,499,836 | B2 | 8/2013 | Moriarty et al. | |
| 2005/0284624 | A1 | 12/2005 | Libby et al. | |
| 2006/0054322 | A1 | 3/2006 | Rose | |
| 2006/0142945 | A1 * | 6/2006 | McLaughlin | E21B 47/0006 702/9 |
| 2007/0151732 | A1 | 7/2007 | Clemens et al. | |
| 2012/0090843 | A1 | 4/2012 | Bagapov et al. | |
| 2013/0000909 | A1 | 1/2013 | Schultz et al. | |
| 2016/0258270 | A1 * | 9/2016 | Hradecky | E21B 47/01 |

OTHER PUBLICATIONS

Int'l Search Report and Written Opinion in PCT/US2016/035569 dated Sep. 7, 2016.

* cited by examiner

MULTIMODAL TOOL JAR

FIELD OF THE DISCLOSURE

In one aspect, this disclosure relates generally to methods for conveying tools in a wellbore. Other aspects relate generally to drilling or completing a wellbore. More particularly, this disclosure relates to methods, devices, and systems for curing a stuck condition of a tubular, drill pipe, borehole assembly, logging tool, or drill bit in a borehole intersecting an earth formation.

BACKGROUND OF THE DISCLOSURE

Oil well logging has been known for many years and provides an oil and gas well driller with information about the particular earth formation being drilled. In conventional oil well operations (during well drilling and/or after a well has been drilled), a rigid or non-rigid conveyance device is often conveyed in a wellbore. For example, in logging operations, a sensor may be conveyed into a borehole and used to determine one or more parameters of interest of the formation. Another example is well intervention operations where the conveyance device is intended to perform operations other than logging, such as perforating, cleaning, milling, cutting, shifting valves, fishing, etc. Communication channels between the conveyance device and its surface acquisition and control equipment provide for the exchange of information and operational commands. During conveyance of the tool into and out of a well there is ample opportunity for the tool to become stuck. This is particularly true in deviated wells.

SUMMARY OF THE DISCLOSURE

In aspects, the present disclosure is related to methods and apparatus for operating a tool string in a borehole intersecting an earth formation. Aspects according to the present disclosure may include a method for alleviating a stuck condition of a tool string. One embodiment according to the present disclosure may be a method of releasing a downhole tool string experiencing a stuck condition relative to a borehole intersecting an earth formation, including using a jarring assembly comprising a plurality of impact surfaces internal to the tool to impart at least one impact load to the stuck tool string by colliding the plurality of impact surfaces together. The at least one impact load results in at least a shock wave inducing i) translational motion along the longitudinal axis of the tool string, and ii) motion in at least one other degree of freedom sufficient to alleviate the stuck condition of the tool string. The motion in the at least one other degree of freedom may be at least one of: i) translational motion along an axis substantially normal to the longitudinal axis, and ii) rotational motion.

The at least one impact load may be configured to overcome a force normal to the borehole wall resulting from a pressure differential between the borehole and the earth formation. The at least one impact load may include a first component along a longitudinal axis of the tool, and a second component sufficient to alleviate the stuck condition of the tool string by producing at least one of: i) lateral motion along an axis normal to the longitudinal axis, and ii) rotational motion. The second component may be normal to the first component.

In general embodiments, at least one of the plurality of impact surfaces may be asymmetric about the longitudinal axis. In some embodiments the method may include releasing a mechanical constraint in response to activation of the jarring assembly to cause movement of a first impact surface of the jarring assembly to collide with a second impact surface of the jarring assembly to apply the at least one impact load. In other embodiments, the method may include operating a hydraulic mechanism in response to activation of the jarring assembly to cause movement of a first impact surface of the jarring assembly to collide with a second impact surface of the jarring assembly to apply the impact load.

The method may include using the jarring assembly to impart the component normal to the longitudinal axis with a first set of impact surfaces of the plurality of impact surfaces and using the jarring assembly to impart a non-normal component of the at least one impact load with a second set of impact surfaces of the plurality of impact surfaces. The method may include imparting the normal component at a different time than the non-normal component. The method may include imparting the normal component substantially simultaneously as the non-normal component. The method may include imparting the normal component at the same axial depth on the tool as the non-normal component, or at a different axial depth on the tool than the non-normal component.

The method may include imparting a plurality of impact loads on the tool, wherein a first impact load of the plurality of impact loads is at a different axial depth on the tool than a second impact load of the plurality of impact loads. The at least one impact load may be further configured to generate at least one of: i) a component of rotation about the longitudinal axis; and ii) a component of rotation normal to the axis.

The jarring assembly may include an axially traveling member with a first impact surface of the plurality of impact surfaces connected operatively thereto; a second impact surface of the plurality of impact surfaces positioned on another member at an axial distance from the first impact surface; a biasing member urging the axially traveling member to an impact location wherein the first impact surface meets the second impact surface; and a constraint configured to prevent travel of the axially traveling member to the impact location prior to triggering, the constraint further configured to suddenly allow the axially traveling member to freely accelerate toward the impact location upon triggering until the first impact surface and the second impact surface collide; wherein the first impact surface and the second impact surface are oriented to generate the normal component upon collision. A path of travel of the first impact surface after triggering may be helical. The constraint may be triggered by tensioning the biasing member past a threshold tension. The jarring assembly may include a controller configured to modify the threshold tension while the apparatus is downhole.

The at least one impact load may include a plurality of impact loads, and the jarring assembly may be configured to impart the plurality of impact loads in sequence.

Aspects of the method may include taking a measurement with a sensor on the tool string responsive to at least one of the impact loads and the shock waves; and using at least one processor to estimate an effectiveness of the impact load, and control the jarring assembly in dependence upon the effectiveness estimated to optimize the next jarring event. In some cases a sequence of several jarring events will be required to free the stuck tool where each event is optimized based on the sensor response analysis of the previous jarring event.

Another embodiment according to the present disclosure may be a jarring apparatus associated with a downhole tool for use in a borehole intersecting an earth formation. The apparatus may include a jarring assembly comprising a plurality of impact surfaces internal to the tool to impart at least one impact load to the stuck tool string by colliding the plurality of impact surfaces together. The jarring assembly may be configured to provide an impact load resulting in at least a shock wave inducing i) translational motion along the longitudinal axis of the tool string, and ii) motion in at least one other degree of freedom sufficient to alleviate the stuck condition of the tool string. The motion in the at least one other degree of freedom may be at least one of: i) translational motion along an axis substantially normal to the longitudinal axis, and ii) rotational motion.

Another embodiment according to the present disclosure may be a method of conveying a downhole tool in a borehole intersecting an earth formation. The method may include using a jarring assembly comprising a plurality of impact surfaces internal to the tool to impart at least one impact load to the tool by colliding the plurality of impact surfaces together while the tool is experiencing a stuck condition relative to the borehole such that the impact load substantially comprises a component normal to a longitudinal axis of the tool and sufficient to alleviate the stuck condition of the tool.

Another embodiment according to the present disclosure may be a jarring apparatus associated with a downhole tool for use in a borehole intersecting an earth formation. The apparatus may include a jarring assembly internal to the tool configured to impart at least one impact load to the tool sufficient to alleviate a stuck condition of the tool relative to the borehole, the at least one impact load substantially comprising a component normal to a longitudinal axis of the tool.

Another embodiment according to the present disclosure may be a method of releasing a downhole tool string experiencing a stuck condition relative to a borehole intersecting an earth formation. The method may include generating at least one test impact load using a jarring assembly; generating movement information from a sensor responsive to the at least one test impact load; and generating further impact loads using the jarring assembly in dependence upon the movement information. The method may include generating additional movement information from a sensor responsive to the further impact loads; and generating additional further impact loads using the jarring assembly in dependence upon the additional movement information. In some cases, the method may include applying a sequence of several jarring events required to free the stuck tool where each event is optimized based on the sensor response analysis of the previous jarring event. Each event may include one or more impact loads in various orders and locations. Generating at least one test impact load using a jarring assembly may include inducing: i) translational motion along the longitudinal axis of the tool string, and ii) motion in at least one other degree of freedom.

Another embodiment according to the present disclosure may be a method for estimating a parameter of the sticking mechanism, drilling process, and one or more earth formation properties, comprising: estimating the parameter or property using information from a sensor incorporated into an apparatus of the present disclosure.

Another embodiment according to the present disclosure may be an apparatus for estimating a parameter of an earth formation, comprising: a processor; a non-transitory computer-readable medium; and a program stored by the non-transitory computer-readable medium comprising instructions that, when executed, cause the processor to estimate the parameter using information obtained from a sensor incorporated in the apparatus of the present invention.

Examples of features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

Figure 1A:
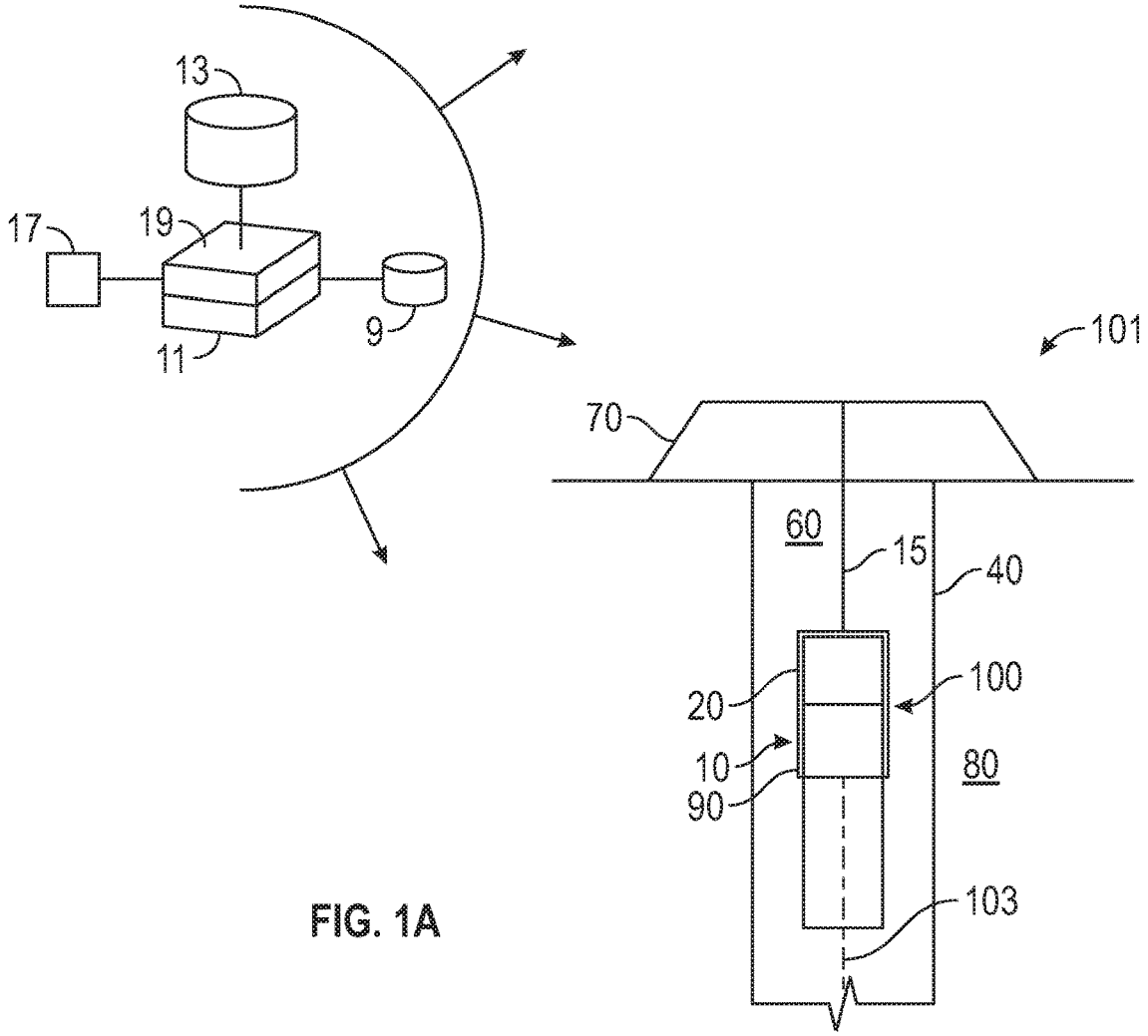
FIGS. 1A-1D illustrate devices in accordance with embodiments of the present disclosure for releasing a downhole tool string experiencing a stuck condition relative to a borehole intersecting an earth formation.

In aspects, the present disclosure relates to operating a tool string in a borehole intersecting an earth formation. Aspects according to the present disclosure may include a method for alleviating a stuck condition of the tool string using a jarring assembly.

Jarring assemblies typically work by storing and releasing energy. For example, a jar may restrain movement of a mandrel within a housing while a strain is taken in a pipe string to stretch it and thereby store a significant amount of potential energy. The mandrel is then quickly released, allowing it move freely. Potential energy is converted to kinetic energy, which results in the impact of opposing surfaces producing the jarring force.

In oil well operations (during well drilling and/or after a well has been drilled), a rigid or non-rigid conveyance device is often used to convey a tool in a wellbore. Often the conveyance device, the tool, and/or a tool string incorporating the tool may become stuck. Stuck, as used herein, means that the conveyance device and/or tool is experiencing a set of physical conditions that in a practical or absolute sense prevents further movement of the tool along the wellbore. One example of a stuck tool is a tool that cannot be moved without damaging it or the tool string. A jarring assembly may be deployed in the tool or the tool string to alleviate this stuck condition.

According to conventional thinking regarding stuck downhole tools, the stuck condition may occur when a portion of a side wall of the wellbore collapses and portions of the formation fall into the annulus between the tool and the wall of the well bore. This is thought to occur in drilling contexts, typically resulting in seizing of the drill string at the drill collars, as well as in wireline contexts. Alternatively, it is thought that a drill bit may be deflected, which causes the drill bit to drift from its intended course and placing the drill string in a transverse bind (e.g., key seating). Partly as a result of this thinking, current wireline jars are designed to deliver a tensile strike within or parallel to the tool axis to overcome the stuck condition.

In a typical jar design, a pair of inner and outer telescoping members permit relative movement of an upper section of drill pipe, a wire line tool, etc., relative to a stuck lower section. When the telescoping members are pulled to the full extent, jarring occurs, which will loosen the tool and allow it to be removed from the well. Jarring activity can occur on upward movement, downward movement or both.

Aspects of the present disclosure includes methods, devices, and systems alleviating the stuck condition of a downhole tool by mitigating forces normal to the borehole axis, such as, for example, forces resulting from a pressure differential between the borehole and the earth formation. This sticking force, normal to the wellbore axis, keeps the tool or tool string attached to the borehole wall.

Device embodiments in accordance with the present disclosure include jarring assemblies which, in addition to delivering a tensile strike parallel to the tool axis, are also configured to induce motion in at least one of the other degrees of freedom. It should be noted that a second co-axial strike in the opposite direction of the tensile strike would not introduce another degree of freedom, as conventionally understood and used herein. As one example, the tool may deliver a strike normal to the tool axis. The motion in the other degrees of freedom may be directly excited. This multimodal jarring technique overcomes force components normal to the borehole axis, which decreases frictional and other forces acting in the direction of the longitudinal tool axis.

Using conventional methods, it is often necessary to deliver an impact that results in damage to the tool in order to free the tool from the stuck condition. When this occurs, it may be necessary to pull the damaged tool string out of the borehole and run a fresh tool string, which is costly and time-consuming. By delivering moderate jarring shocks in multiple directions, excessive force may be avoided. By limiting the impact delivered on the tool, jarring assemblies of the present disclosure avoid damage to the internal components and assemblies of the tool. In turn, this enables completing the operation without delay once the tool string is free.

FIGS. 1A-1D illustrate devices in accordance with embodiments of the present disclosure for releasing a downhole tool string experiencing a stuck condition relative to a borehole intersecting an earth formation. Figures are not drawn to scale. FIG. 1A illustrates a tool 10 conveyed in a borehole intersecting a formation 80 on tool string 100. The borehole 40 may be filled with a downhole fluid 60. The tool 10 may contain a sensor assembly 90, including, for example, one or more acoustic or electromagnetic transmitters and receivers, configured for evaluation of the borehole or the formation according to known techniques, for taking measurements indicative of drilling parameters, borehole properties, formation properties, or for parameters indicative of jarring effects. Sensor assembly 90 may be contained in a single tool or distributed about the tool string, the surface, or at other locations in the borehole or the formation.

The system 101 may include a conventional derrick 70. A conveyance device 15, which may be rigid or non-rigid, may be configured to convey the downhole tool 10 into wellbore 40 in proximity to formation 80. The conveyance device 15 may be a drill string, coiled tubing, a slickline, an e-line, a wireline, etc. Downhole tool 10 may be coupled or combined with additional tools. Thus, depending on the configuration, the tool 10 may be used during drilling and/or after the wellbore (borehole) 40 has been formed. While a land system is shown, the teachings of the present disclosure may also be utilized in offshore or subsea applications. The conveyance device 15 may include embedded conductors for power and/or data for providing signal and/or power communication between the surface and downhole equipment. The conveyance device 15 may include a bottom hole assembly, which may include a drilling motor for rotating a drill bit to extend the borehole, and a system for circulating a suitable drilling fluid (also referred to as the "mud") under pressure.

Figure 1B:
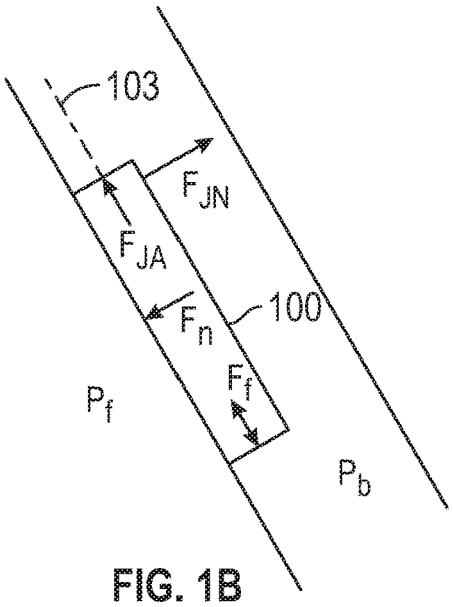

FIG. 1B illustrates forces on the tool string 100 resulting in a stuck condition stemming from a pressure differential ($\Delta P$) between the borehole pressure (Pb) and the formation pressure (Pf). The pressure differential may be as high as 500-1000 psi or higher. Force normal on the tool string (Fn) is approximately equal to Area (A) of the tool string proximate the borehole wall 40 multiplied by $\Delta P$. Frictional force (Ff) is directly related to the normal force.

The tool 10 is in a deviated borehole. The toolstring 100 includes a jarring assembly 20 configured to deliver a jarring force component in the axial direction (i.e., along the longitudinal axis 103 of the tool 10 and toolstring 100) (FJA) and a second component normal to the longitudinal tool axis 103 (FJN).

In another embodiment of this invention, two striking surfaces with different impact angles and located at a predefined distance are used to synchronize the arrival of both striking waves, axial and normal, over the most likely sticking section of the string. Shock waves may travel at different speeds in different directions and through different materials, and the assembly may be configured for simultaneous or sequential arrival of shock waves at likely sticking points.

One embodiment according to the present disclosure may be a method of releasing a downhole tool string experiencing a stuck condition relative to a borehole intersecting an earth formation, including using a jarring assembly comprising a plurality of impact surfaces internal to the tool to impart at least one impact load to the stuck tool string by colliding the plurality of impact surfaces together. The at least one impact load may be configured to be sufficient to overcome a force normal to the borehole wall resulting from a pressure differential between the borehole and the earth formation by producing shock waves and forces generating motion in the tool.

Figure 1C:
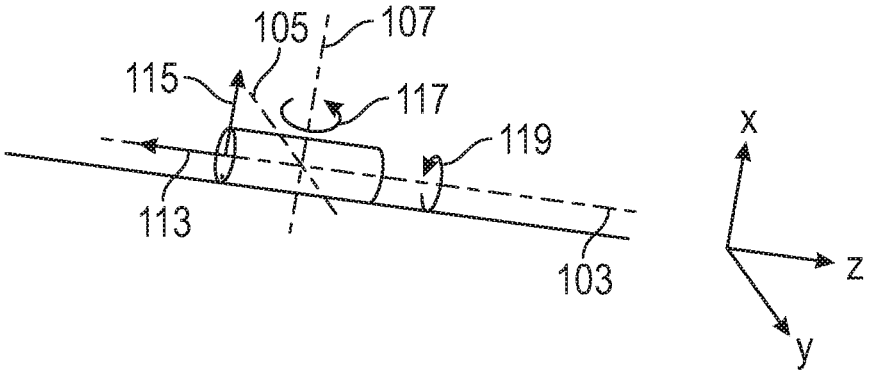

FIG. 1C illustrates the six degrees of freedom (of motion) of the tool string, approximated as a rigid body. The tool string may have three primary axes which are orthonormal to one another: the longitudinal axis of the tool, z (103); x, the first azimuthal axis (105); and y, the second azimuthal axis (107). Movement of the tool string may be translational (along one or more of the three axes) or rotational (about one or more of the three axes). Rotational motion about the x, y, and z axes may be referred to as yawing (swivels "left" and "right"); pitching (tilts forward and backward); and rolling (pivots side to side), respectively. In FIG. 1C, the at least one impact load results in at least a shock wave inducing i) translational motion along the longitudinal axis of the tool string, and ii) motion in at least one other degree of freedom sufficient to alleviate the stuck condition of the tool string. That is, the jarring action of the jarring assembly in FIG. 1C is multimodal.

Figure 1D:
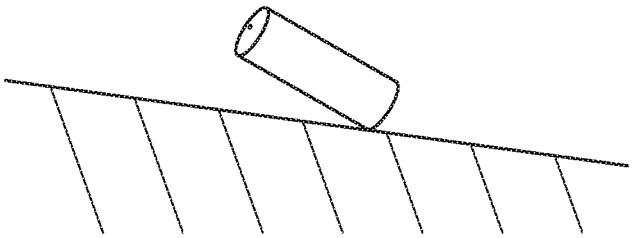

The motion in the at least one other degree of freedom may be at least one of: i) translational motion along an axis substantially normal to the longitudinal axis, and ii) rotational motion. As shown in the example of FIG. 1C, the motion in the at least one other degree of freedom comprises both translational and rotational motion. The jarring assembly induces in the tool string translational motion 113 along the longitudinal axis 103 of the tool string. The jarring assembly also induces in the tool string translational motion 115 along the x axis 105 of the tool string, rotational motion 117 about the y axis 107, and rotational motion 119 about the longitudinal (z) axis. This is beneficial, as the action of translationally moving the tool string in combination with pitching and rolling the tool string employs the benefits of mechanical advantage to move the tool string away from the area of the borehole wall causing the stuck condition. Consequentially, smaller forces may be used, with greater effect, than in the case of axial translational motion alone. FIG. 1D illustrates a new position of the tool in the borehole following activation of the jarring assembly of FIG. 1C to induce motion.

The use of jarring mechanisms to produce shocks along the longitudinal axis of the tool (also referred to herein as 'the longitudinal tool axis' or simply, 'the longitudinal axis') by colliding a plurality of impact surfaces is well known. Typically a first impact surface, often carried on a mandrel and referred to as a "hammer," is axially accelerated toward a second impact surface, often referred to as the "anvil." A release mechanism is used to accelerate the impact surfaces to collision. Embodiments discussed herein below disclose various implementations within the scope of the present disclosure.

Figure 2A:
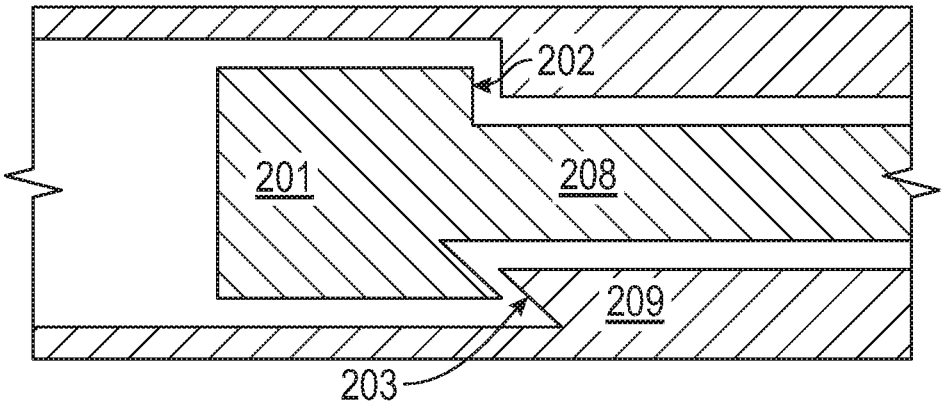
FIGS. 2A-2C illustrate impact surfaces in accordance with embodiments of the present disclosure.
Figure 2B:
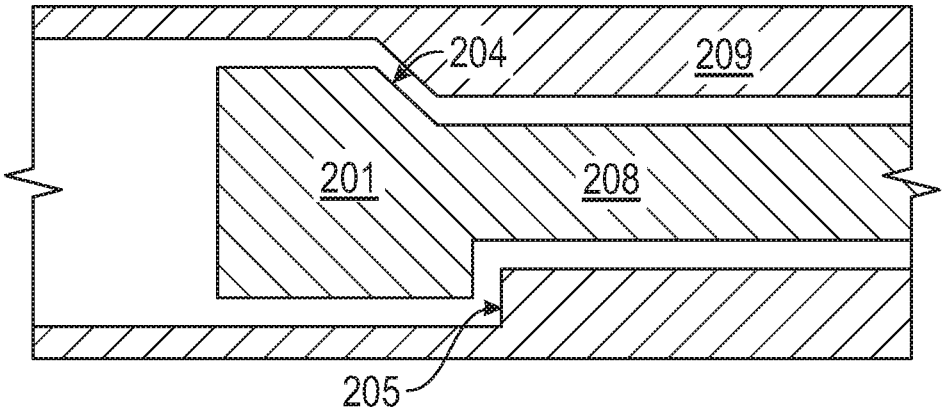
Figure 2C:
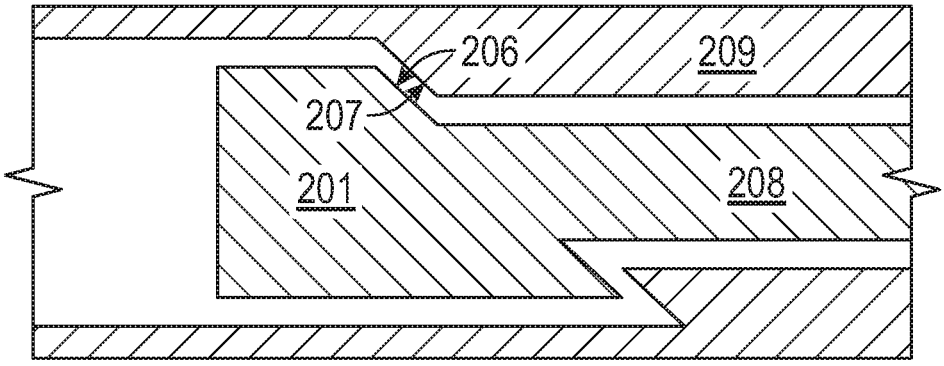

FIGS. 2A-2C illustrate impact surfaces 202-207 that are axially asymmetric. The impact surfaces 202, 204 and 206 are attached to hammer member 201 coupled to axially traveling member 208. The impact surfaces 203, 205, and 207 are attached to anvil body 209. The impact surfaces (or portions thereof) may be inclined towards a particular azimuth. The inclination may be selected to distribute the jarring energy between the axial and normal shock waves created by the jarring strike according to desired proportions, while imparting the normal component at the same axial depth on the tool as the non-normal component.

In some instances, impact surfaces are configured to generate rotation, either through surface shape (e.g., employing helical segments) or by having axially or radially offset impact loads. (Other techniques for generating rotation are discussed in greater detail with reference to FIGS. 7A-7D below.) It should be appreciated that impact surfaces may be placed in any convenient location in the tool. In some embodiments, a plurality of sets of impact surfaces may be placed in multiple locations on the tool, as described in greater detail below.

Figure 3:
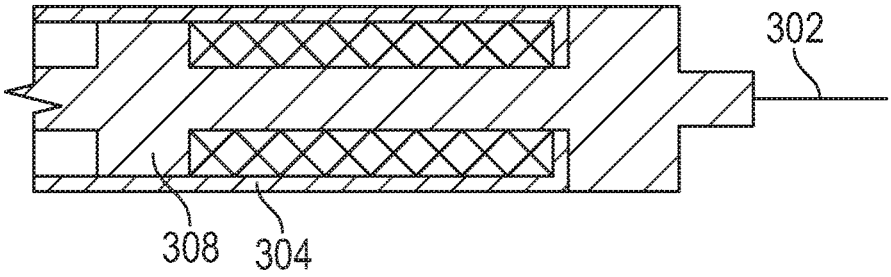
FIG. 3 illustrates a release embodiment of a tool in accordance with embodiments of the disclosure.

FIG. 3 illustrates a release embodiment of a tool in accordance with embodiments of the disclosure. Biasing member 302 urges axially traveling member 308 to an impact location wherein the first impact surface meets the second impact surface. Biasing member 302 may exert either a tensile or compressive force, depending on configuration. Constraint 304 is configured to prevent travel of the axially traveling member to the impact location prior to triggering. The constraint is further configured to suddenly allow the axially traveling member to freely accelerate toward the impact location upon triggering until the first impact surface and the second impact surface collide.

Several types of constraints utilizing a variety of mechanisms may be employed to collide the impact surfaces. Typically these will fall into one of the following categories: mechanical release, hydraulic release, and hybrid release. Each type stores energy and then releases the energy to jar the tool. While mechanical jars may used in either wireline or drilling contexts, hydraulic jars may be too lengthy to be used in wireline tools or coiled tubing applications, or in some instances of deviated boreholes. Hydraulic jars may also have a disadvantageously long metering stroke (amount of relative movement between the mandrel and the housing occurring before the jar is triggered).

A typical hydraulic well jar may employ separate fluid reservoirs with a small passage in a moveable piston for movement of the fluid between. The size of the passage restrains upward movement of a mandrel within a housing while a strain is taken in the pipe string to store potential energy. Once a release position of the piston is reached, the mandrel is allowed to move freely upward. Contraction of the string accelerates the mandrel upward to violently collide a hammer surface on the mandrel against an anvil surface on the housing. In variations, a similar principle may be employed by using a hydraulic valve and a spring.

In a first type of mechanical jar, the release mechanism includes a spring to resist movement of the mandrel relative to the housing. As the spring is compressed under applied force, the mandrel moves toward a release point. A collet attached to the mandrel may release at the release point, allowing the mandrel accelerate toward a violent collision between the impact surfaces. The mechanism is configured so that the release point is reached when the applied force on the mandrel exceeds a predetermined amount (i.e., the triggering load). In other examples, a friction sleeve may be used which resists movement of the mandrel until a triggering load is achieved. The triggering load may be adjustable.

Hybrid jars may combine some elements of both mechanical and hydraulic jars. One design utilizes both a slowly metered fluid and a mechanical spring element to resist relative axial movement of the mandrel and a housing. Other examples may use a mechanical brake.

Figure 4A:
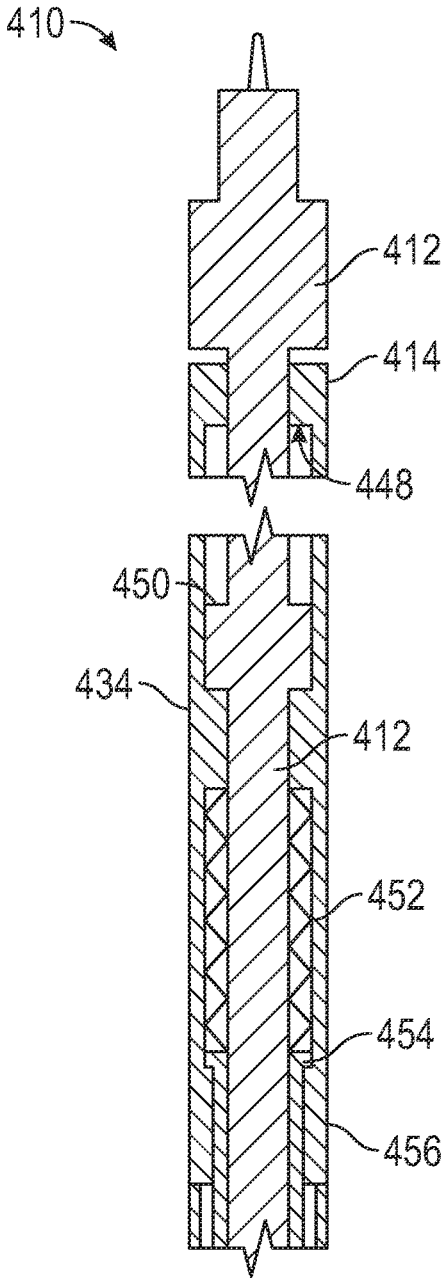
FIGS. 4A and 4B illustrate a jarring tool with a jarring assembly including a mechanical release in accordance with other embodiments of the present disclosure.
Figure 4B:
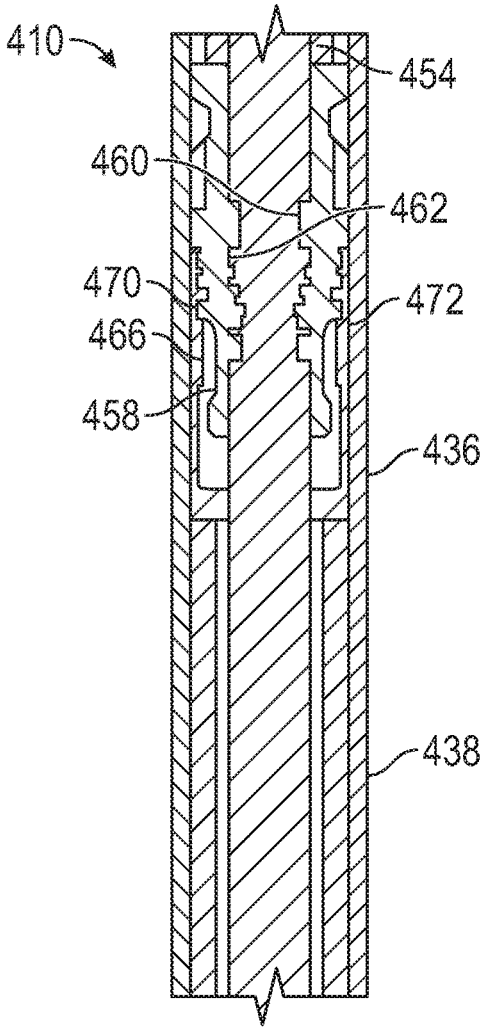

FIGS. 4A and 4B illustrate a jarring tool with a jarring assembly including a mechanical release in accordance with other embodiments of the present disclosure. For convenience, the term "upper" as used herein refers to a direction closer along the wellbore to the surface of the earth formation, and the term "lower" refers to a direction farther along the wellbore from the surface of the earth formation.

The tool 410 has a mandrel 412 disposed within housing 414. The mandrel 412 axially travels with respect to housing 414. The housing 414 has an upper section 434 and a lower section 436. At least one an "anvil" impact surface (e.g., 203, 204, and 207) may be located within lower section 436. A downward-facing impact surface 448 ("anvil") is defined by upper housing section 434. A complementary upward-facing impact surface 450 ("hammer") is defined by the mandrel 412. At least one other set of impact surfaces may lie within lower section 436 and be operatively coupled to mandrel 412.

Within the upper housing section is a compression ring 454, which is restricted in downward movement by shoulder 456. Within the upper housing section and disposed around mandrel 412 is a compression spring 452, which may be implemented as a stack of Bellville washers. Spring 452 may have a spring constant of, for example, a 1000 lb. per inch. Compression spring 452 bears against compression ring 454. Compression ring 454 is axially movable relative to the housing 414. Upward movement of the compression ring causes compression of spring 452. As will be appreciated, spring 452 resists upward axial movement of compression ring 454 and returns compression ring 454 to the position shown in FIG. 4A.

Mandrel 412 is under tension from the surface, via a mechanical linkage between the mandrel 412 and the housing 414 which may be implemented as a generally tubular collet 458 around mandrel 412 and a trigger sleeve 466 within housing 414. A more detailed understanding of the structure of the collet 458 can be obtained by reference to U.S. Pat. No. 6,290,004, which is hereby incorporated by reference in its entirety. Collet 458 has a plurality of fingers 460 facing the longitudinal tool axis. The exterior surface of mandrel 512 is provided with a plurality of external grooves 462 configured to accept the inwardly facing fingers 460. While fingers 460 are engaged in physical engagement with the grooves 462, axial force applied to the mandrel 512 is transmitted through the compression ring 454 via the collet 458. Trigger sleeve 466 is located within housing 414 proximate the location of collet 458. The upper end of trigger sleeve 466 is provided with a plurality of grooves 470. The grooves are sized and configured to receive the outwardly projecting flanges 472 of collet 458.

Compression spring 452 functions to hold back the upward movement of the mandrel 412 and build up potential energy in the wireline by resisting upward axial movement of compression ring 454 while mandrel 412 is under tension from the surface. When an upward axial force is applied to mandrel 412, collet 458 is urged axially upward relative to sleeve 466. Upon the outwardly projecting flanges 472 of collet 458, achieving alignment with the grooves 470 of trigger sleeve 466, the collet radially expands to seat the flanges 472 in the grooves 470, which releases the mechanical link between mandrel 412 and housing 414. In response to the release, mandrel 412 rapidly accelerates upwards causing the hammer impact surface 450 to collide with anvil impact surface 448, which imparts at least one impact load comprising a normal component on the tool stuck in the borehole. Additional impact loads may be imparted by other colliding impact surfaces (e.g., 203, 205, and 207) in lower section 436.

The applied load at which the jar is triggered depends upon the spring constant of spring 452 and the travel of collet 458 relative to trigger sleeve 466 before grooves 470 are received by flanges 472. For example, ignoring any preloading of the spring, if the spring constant is 1,000 lbs. per inch and the range of movement of collet 458 before reaching trigger sleeve 466 is one inch, the trigger load will be 1,000 pounds. If the range of movement is extended to one and one-half inches, then there will be a corresponding increase in the trigger load to 1,500 pounds.

In alternative embodiments, the jarring assembly may feature an adjustable triggering load. A spring compression member (e.g., a threaded compression rod) may be disposed within the housing below the compression spring 452. The lower end of the compression rod may be secured to a spindle of a rotary motor secured underneath. At the direction of a controller, which may be operatively coupled to a telemetry module, the motor may rotate the compression rod such that a lowering or raising motion is produced. The movement of the compression rod modifies the compression of the spring and thereby adjusts the range of movement of the collet 458. A power supply (e.g., a battery) may provide power for the motor to operate.

Adjustment of the trigger load, therefore, can be accomplished by adjusting the position of trigger sleeve 466 within housing 414 to assume a different position relative to collet 458, to modify the distance of travel necessary to place the flanges 472 within grooves 470. In order to adjust the position of trigger sleeve 466 within housing 414, the axial location of adjustment mandrel 438 relative to housing 414 can be adjusted by rotating adjustment mandrel 438 relative to the housing sections. This adjustment may be effected by mechanical, hydraulic, or electronic actuation.

Figure 5:
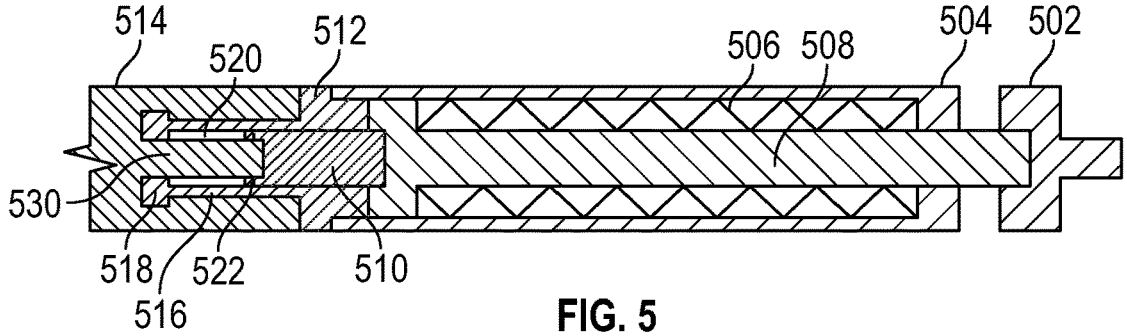
FIG. 5 illustrates a tool having a jarring assembly with a mechanical release in accordance with other embodiments of the present disclosure.

FIG. 5 illustrates a tool having a jarring assembly with a mechanical release in accordance with other embodiments of the present disclosure. Connection member 502 allows for attachment with the biasing member, which in alternative embodiments may be a wireline, a tool string, or a drill string. Mandrel 508 is coupled with connection member 502 and at least a portion of mandrel 508 is received interior to upper housing 504.

Mandrel 508 has an expanded diameter at a lower end, where it threadedly receives secondary mandrel 510. Secondary mandrel 510 is operatively coupled to axially traveling member 530 (e.g., 208, 308, FIGS. 2A-2C, 3). Release collet 512 is operatively coupled at the lower end of upper housing 504.

At least one an "anvil" impact surface (e.g., 203, 205, and 207) lies within lower housing 514. A compression spring 506, which may be implemented as a series of Bellville washers, is located between mandrel 508 and housing 504. Opposing ends of compression spring 506 abut against a shoulder of housing 504 and a shoulder formed on mandrel 508 to resist movement of mandrel 508 upward. Release collet 512 has a plurality of fingers 516 extending from a main body section. A collet release sleeve 520 is operatively connected to axially traveling member 530. A spring washer 522 is positioned on the lower end of secondary mandrel and between the collet release sleeve 520 and the axially traveling member. The collet release sleeve 520 has a plurality of grooves configured to receive protrusions 518 of the fingers 516 when the axially traveling member moves a given distance within the release collet 512.

In operation, a tension applied to the connection member 502 causes axial motion in the mandrel 508 and secondary mandrel 510. Mandrel 508 extends, compressing spring 506. Release sleeve 520 moves with the secondary mandrel 510 and eventually moves to a position where the protrusions on the flexible fingers of the release collet 512 land in the grooves on the release sleeve 520 so that the fingers flex inwardly due to the forces at surrounding surfaces, so that release collet 512 engages the axially traveling member 530 via release sleeve 520. The tension on the wire pulls the mandrel axially toward the surface. Lower housing 514 and the tool attached to it are rapidly released from the first housing and a "hammer" impact surface (e.g., 202, 205 and 206) is rapidly accelerated by axially moving member 530 until it strikes an "anvil" impact surface (e.g., 203, 205, and 207), thereby exerting a force substantially comprising a normal component on the tool stuck in the borehole.

Figure 6:
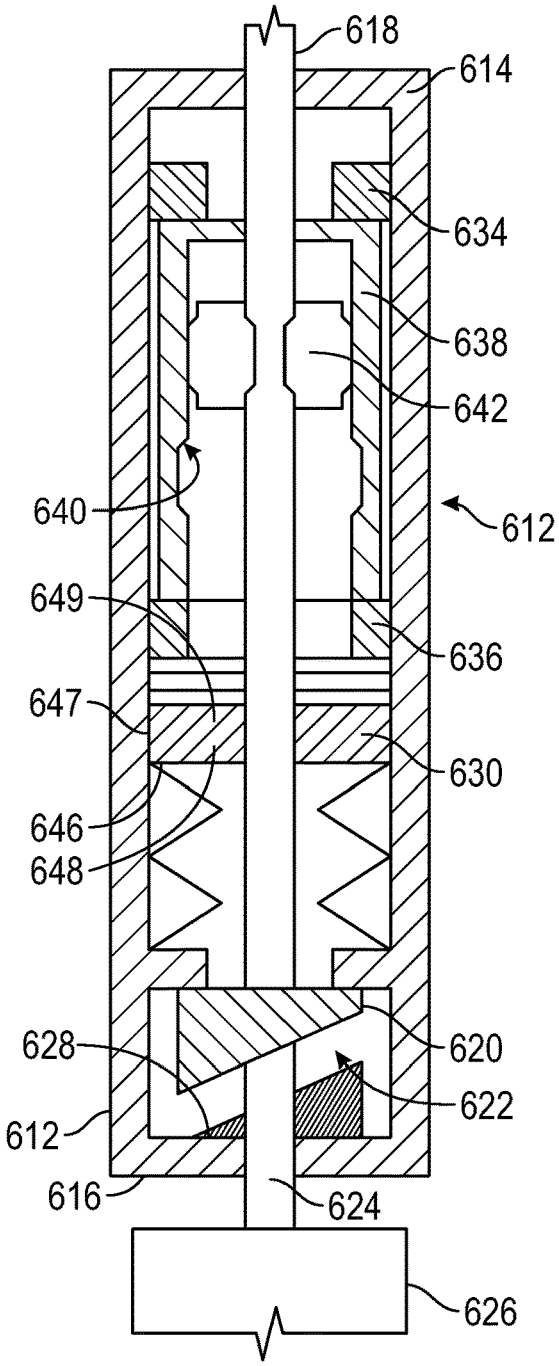
FIG. 6 illustrates a tool having a hydraulic jarring assembly in accordance with embodiments of the present disclosure.

FIG. 6 illustrates a tool having a hydraulic jarring assembly in accordance with embodiments of the present disclosure. The tool comprises a cylindrical housing 612 with a top end 614 and a bottom end 616 defining a sealed cavity within the housing 612. A mandrel 618 within the housing 612 and the housing 612 itself are axially moveable with respect to one another. An anvil 620 is supported on the mandrel 618 and having an "anvil" impact surface 622. A mandrel extension 624 is operatively coupled to anvil member 620. Adaptor 626 at the lower end of mandrel extension 624 may be secured in a conventional manner to lower portions of the tool string. A "hammer" impact surface 628 is provided on top of lower end 616, and collides with the "anvil" impact surface 622 during a jarring action.

Piston 630 and the anvil 620 are each operatively coupled to mandrel 618. Piston 630 is also secured to the mandrel 618, and is biased in an upward position by compression springs 632, such as, for example, Bellville springs. Rings 634 and 636 hold sleeve 638 at upper and lower ends.

An annular groove 640 runs circumferentially on the inner surface of the sleeve. Collet mechanism 642 is engaged with mandrel 618. When aligned with the recess 640, the jarring assembly is configured to allow radial motion of the collet mechanism 642 into annular groove 640. The piston 630 includes a flow path 647 and a metering device 646 therein for metering fluid from the lower chamber below the piston to the upper chamber above the piston. The piston 630 also includes a flow path 648 and a check valve 649 for allowing fluid above the piston to quickly pass beneath the piston when resetting the jar, discussed in further detail below.

As shown in FIG. 6, metering device 646 is within a flow path within the piston, so that the metered fluid passes through the piston 630. In other implementations, the flow path and a metering device are on an outer surface of the piston, so that the metered fluid flows axially past but not through the piston.

Figure 7A:
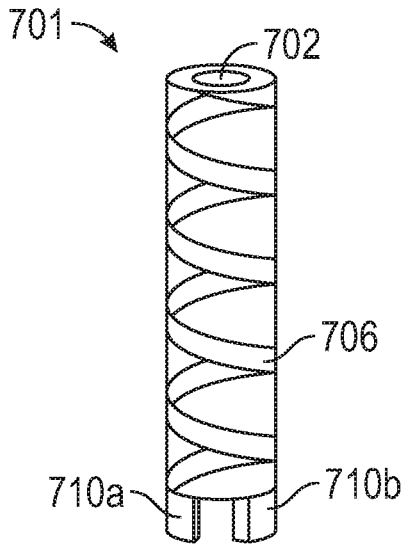
FIGS. 7A-7D illustrate jarring assembly components in accordance with embodiments of the present disclosure.
Figure 7B:
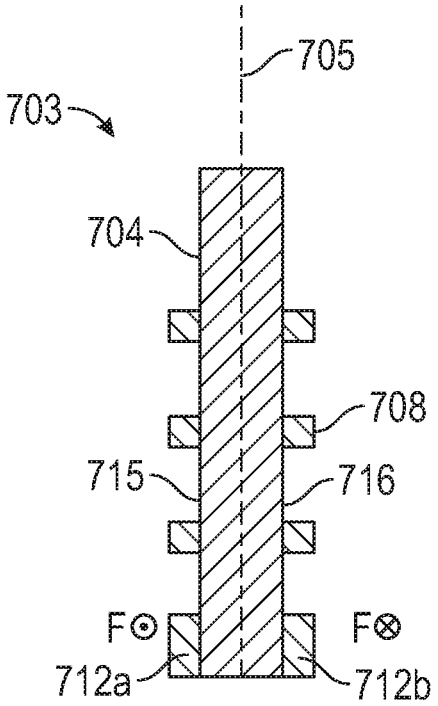

FIGS. 7A-7D illustrate jarring assembly components in accordance with embodiments of the present disclosure. FIG. 7A shows an outer helically-journalled cylindrical member 701. FIG. 7B shows an inner helically-journalled cylindrical member 703. One of the members is connected to a mandrel, as shown in the embodiments above, by a coupler allowing free rotation of the member, while the other of the members may be connected to the housing. Outer helically-journalled cylindrical member 701 includes a central passage 702 so it can be mounted over the main shaft 704 of inner helically-journalled cylindrical member 703. The members 701 and 703 include impact surfaces 710 and 712, respectively, which are non-normal with respect to the longitudinal axis of the tool 705.

Figure 7C:
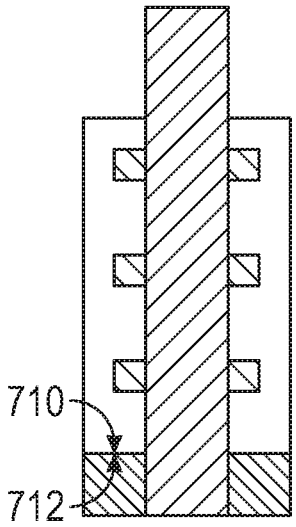
Figure 7D:
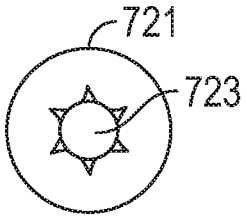

Outer helically-journalled cylindrical member 701 is spirally cut in one or more spiral grooves 706. The spiral grooves 706 on member 701 mesh with spiral key members 708 on member 703. As the mandrel and housing move with respect to one another, the meshing of spiral key members 708 with grooves 706 induces rotational motion of the free member. At the end of the path of travel of the impact surface on the free member, the impact surfaces 710 and 712 collide. Impact surfaces 710*a* and 712*a* generate a first impact load having a normal component to the tool axis on a first side 715 of the tool, while impact surfaces 710*b* and 712*b* generate a second impact load having a normal component to the tool axis on a second side 716 of the tool, wherein the first impact load and the second impact load act in opposite directions. In this way, rotational motion about the tool axis is induced. In other embodiments, the impact surfaces (710', 712') may be normal to the longitudinal axis of the tool, and rotation may be transferred from the free member to the non-free member at impact, as shown in FIG. 7C. FIG. 7D shows an outer helically-splined cylindrical member 721 and an inner helically-splined cylindrical member 723. Other features of the members 721, 723 are similar to those of FIGS. 7A-7C above.

As is readily apparent, by operatively connecting one of the embodiments above with a traditional jarring assembly generating impact loads along the longitudinal tool axis (or with another of the embodiments above), it is straightforward engineering to impart the load component normal to the longitudinal axis with a first set of impact surfaces and the non-normal load component with a second set of impact surfaces. In some instances, imparting the normal component at a different axial depth on the tool than the non-normal component may have beneficial effects.

Further, inclusion of one or more timing mechanisms for colliding the first set of impact surfaces subsequent to colliding another, thereby resulting in a timed delay between delivery of impact loads, is well-known. According to one embodiment, the timing mechanism is implemented in hydraulic devices as a fluid metering device associated with a first set of impact surfaces which meters fluid at a different rate than the fluid metering device associated with a second set of impact surfaces. Alternatively, the timing mechanism may be implemented as a release mechanism associated with a first set of impact surfaces which has a different travel length compared to a release mechanism associated with a second set of impact surfaces, such that a "hammer" impact surface of the first set of surfaces is released prior to the other. Thus, in some instances, it is beneficial to configure the tool string to impart the normal component at a different time than the non-normal component.

In further embodiments, a mechanical release may be incorporated in the tool string that is actuated in response to electrical activation of a jar controller. The mechanical release may have an actuator with a locking member to initially lock the actuator in a first position, wherein electrical activation of the jarring tool causes the locking member to be released to allow for movement of the actuator to trigger the jarring assembly. Timing of different collisions may thus also be facilitated using an electronic timer, digital processor controlled timer, or the like.

Referring again to FIG. 1, certain embodiments of the present disclosure may be implemented with a hardware environment that includes an information processor 11, an information storage medium 13, an input device 17, processor memory 19, and may include peripheral information storage medium 9. The hardware environment may be in the well, at the rig, or at a remote location. Moreover, the several components of the hardware environment may be distributed among those locations. The input device 17 may be any data reader or user input device, such as data card reader, keyboard, USB port, etc. The information storage medium 13 stores information provided by the detectors. Information storage medium 13 may include any non-transitory computer-readable medium for standard computer information storage, such as a USB drive, memory stick, hard disk, removable RAM, EPROMs, EAROMs, flash memories and optical disks or other commonly used memory storage system known to one of ordinary skill in the art including Internet based storage. Information storage medium 13 stores a program that when executed causes information processor 11 to execute the disclosed method. Information storage medium 13 may also store the formation information provided by the user, or the formation information may be stored in a peripheral information storage medium 9, which may be any standard computer information storage device, such as a USB drive, memory stick, hard disk, removable RAM, or other commonly used memory storage system known to one of ordinary skill in the art including Internet based storage. Information processor 11 may be any form of computer or mathematical processing hardware, including Internet based hardware. When the program is loaded from information storage medium 13 into processor memory 19 (e.g. computer RAM), the program, when executed, causes information processor 11 to retrieve sensor information from either information storage medium 13 or peripheral information storage medium 9 and process the information to estimate a parameter of interest. Information processor 11 may be located on the surface or downhole.

Figure 8:
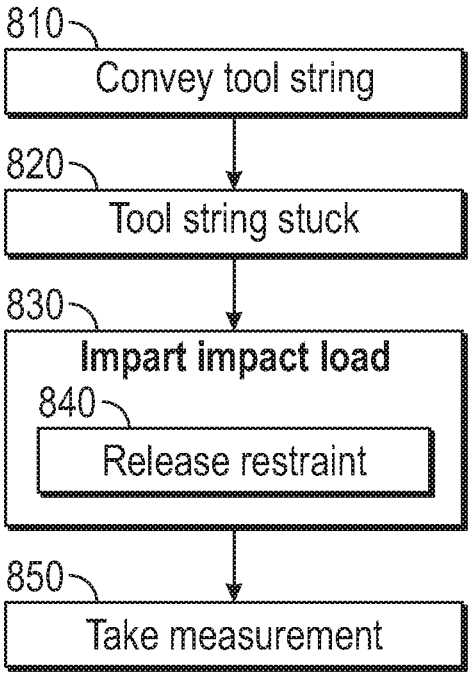
FIG. 8 illustrates a method for releasing a downhole tool string experiencing a stuck condition relative to a borehole intersecting an earth formation in accordance with embodiments of the present disclosure.

FIG. 8 illustrates a method for releasing a downhole tool string experiencing a stuck condition relative to a borehole intersecting an earth formation in accordance with embodiments of the present disclosure. Optional step 810 includes conveying a tool string into a borehole in an earth formation, wherein the tool string includes a tool having a jarring assembly comprising a plurality of impact surfaces internal to the tool. Optional step 820 is carried out by allowing the tool string to achieve a stuck condition.

Step 830 includes using the jarring assembly to impart at least one impact load to the stuck tool string by colliding the plurality of impact surfaces together, the at least one impact load resulting in at least a shock wave inducing i) translational motion along the longitudinal axis of the tool string, and ii) motion in at least one other degree of freedom sufficient to alleviate the stuck condition of the tool string. In some instances, the motion in the at least one other degree of freedom may be at least one of: i) translational motion along an axis substantially normal to the longitudinal axis, and ii) rotational motion. The at least one impact load may include a first component along a longitudinal axis of the tool, and a second component (which may be normal to the first component) sufficient to alleviate the stuck condition of the tool string by producing at least one of: i) lateral motion along an axis normal to the longitudinal axis, and ii) rotational motion. The rotational motion may include a component of rotation about the longitudinal axis; and a component of rotation normal to the axis. The at least one of the plurality of impact surfaces may be asymmetric about the longitudinal axis.

Step 830 may include optional step 840, which comprises releasing a restraint. Optional step 840 may be carried out by releasing a mechanical constraint in response to activation of the jarring assembly to cause movement of a first impact surface of the jarring assembly to collide with a second impact surface of the jarring assembly to apply the at least one impact load. Releasing the mechanical constraint may be initiated by tensioning the biasing member past a threshold tension. Additional steps (not shown) may include modifying the threshold tension while the apparatus is downhole. For example, compression springs may be preloaded to a set pull tensile or compression level to trigger the jarring assembly. The trigger level may then be adjusted via a telemetry module on the tool string in electrical communication with an adjustment motor as described above.

Alternatively, optional step 840 may be carried out by operating a hydraulic mechanism in response to activation of the jarring assembly to cause movement of a first impact surface of the jarring assembly to collide with a second impact surface of the jarring assembly to apply the impact load.

Step 830 may include using the jarring assembly to impart the load component normal to the longitudinal axis with a first set of impact surfaces of the plurality of impact surfaces and using the jarring assembly to impart the non-normal component of the at least one impact load with a second set of impact surfaces of the plurality of impact surfaces.

Step 830 may include imparting the normal component at a different time than the non-normal component; imparting the normal component substantially simultaneously as the non-normal component; imparting the normal component at the same axial depth on the tool as the non-normal component; imparting the normal component at a different axial depth on the tool than the non-normal component; and imparting a plurality of impact loads in sequence.

Step 850 comprises taking a measurement with a sensor on the tool string responsive to at least one of the impact load and the shock wave; and using at least one processor to estimate an effectiveness of the impact load and control the jar apparatus in dependence upon the effectiveness.

Figure 9:
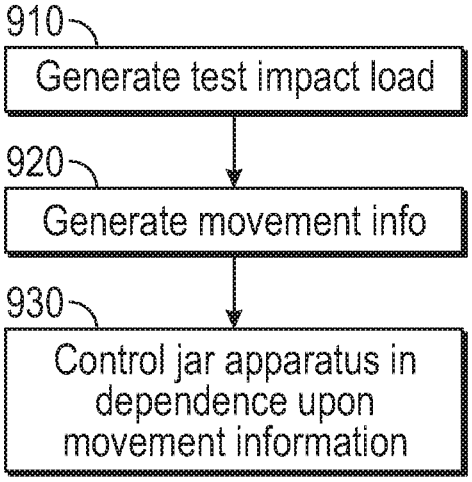
FIG. 9 illustrates another method for releasing a downhole tool string experiencing a stuck condition relative to a borehole intersecting an earth formation in accordance with embodiments of the present disclosure.

FIG. 9 illustrates another method for releasing a downhole tool string experiencing a stuck condition relative to a borehole intersecting an earth formation in accordance with embodiments of the present disclosure. The technique is directed to characterizing the stuck condition with kinetic energy measurements associated with movement of the stuck tool string.

Step 910 of the method comprises generating at least one test impact load. This may be carried out using a multi-modal jarring assembly, and may include inducing i) translational motion along the longitudinal axis of the tool string, and ii) motion in at least one other degree of freedom. This may include generating at least one test impact load configured to excite all six the multi-modal degrees of motion freedom. Step 920 comprises generating movement information from a sensor responsive to the at least one test impact load. The movement information is indicative of a reaction (e.g., motion and acceleration) of at least a portion of the tool string to the at least one test impact load. As one example, step 920 may be carried out by utilizing accelerometers to measure motion of one or more components of the tool string. Step 920 may also be carried out using a transducer or other microphone to measure acoustic or pressure waves indicative of impact load efficacy in a particular direction.

Step 930 comprises controlling the jarring assembly in dependence upon the movement information. Step 930 may include identifying which degree of freedom excitation and directions (moment and linear motion) caused the most effective deflective motion away from the stuck position and/or identifying the most optimum excitation which minimum effort is most likely to free the equipment, and then using selected ones of several jarring sub-assemblies of the tool to generate an impact load corresponding to the identified motion. This step may include determining which multi-mode jar impact has the highest predicted effectiveness—that is, which impact is most likely to dislodge the tool string on a second step with minimum impact force and minimum damage to electronics, sensors (or other sensitive parts), modules, linkages, and so on in the tool string. For example, it may be estimated which tool string motion mode responded more effectively to the jarring assembly's multi-mode kinetic energy impact excitation. This analysis may take into account the borehole size, inclination (vertical, deviated, horizontal, etc.), and so on. A measure of transmitted kinetic energy, such as amplitude of the detected sound wave or extent of movement, is used as an indication of likelihood that the associated motion is more likely to be successful in the follow up jar. Adjustment may be automatic or via commands from the surface via a telemetry module. Incremental adjustment may be implemented via feedback in a closed loop. Multi-modal jarring may be applied according to optimized force levels and prescribed time sequence, and, in some instances, at optimized different depth levels along the tool.

A surface control unit or processor(s), as described with respect to FIG. 1 may receive signals from downhole sensors and devices and signals from sensors used in the system and process such signals according to programmed instructions provided to the surface control unit. The surface control unit may include a computer or a microprocessor-based processing system, memory for storing programs or models and data, a recorder for recording data, and other peripheral devices. The control unit may also be implemented with an application specific integrated circuit ('ASIC'), field-programmable gate array ('FPGA'), or other digital or analog logical circuitry.

Sensors may be configured to acquire information relating to the downhole feature(s) of interest. The sensors may be in signal communication with a controller via a suitable communication line. It should be understood that the type of sensors used on tool may depend in part on the downhole feature to be investigated.

The term "conveyance device" as used above means any device, device component, combination of devices, media and/or member that may be used to convey, house, support or otherwise facilitate the use of another device, device component, combination of devices, media and/or member. Exemplary non-limiting conveyance devices include drill strings of the coiled tube type, of the jointed pipe type and any combination or portion thereof. Other conveyance device examples include casing pipes, wirelines, wire line sondes, slickline sondes, drop shots, downhole subs, BHA's, drill string inserts, modules, internal housings and substrate portions thereof, self-propelled tractors. The terms "operatively coupled" and "operatively connected" may mean that components are connected (e.g., mechanically or hydraulically) such that movement of one corresponds with predicable cooperative movement of the other. Components may be operatively coupled through mandrels, linkages, pistons, and so on.

The term "information" as used above includes any form of information (analog, digital, EM, printed, etc.). The term "information processing device" or "processor" herein includes, but is not limited to, any device that transmits, receives, manipulates, converts, calculates, modulates, transposes, carries, stores or otherwise utilizes information. An information processing device may include a microprocessor, resident memory, and peripherals for executing programmed instructions.

While the present disclosure is discussed in the context of a hydrocarbon producing well, it should be understood that the present disclosure may be used in any borehole environment (e.g., a water or geothermal well).

The present disclosure is susceptible to embodiments of different forms. There are shown in the drawings, and herein are described in detail, specific embodiments of the present disclosure with the understanding that the present disclosure is to be considered an exemplification of the principles of the disclosure and is not intended to limit the disclosure to that illustrated and described herein. While the foregoing disclosure is directed to the one mode embodiments of the disclosure, various modifications will be apparent to those skilled in the art. It is intended that all variations be embraced by the foregoing disclosure.

We claim:

1. A method of releasing a downhole tool string experiencing a stuck condition relative to a borehole intersecting an earth formation, the method comprising:

using a jarring assembly comprising a plurality of impact surfaces internal to a tool of the tool string to impart at least one impact load to the stuck tool string, wherein the tool string is supported by a non-rigid conveyance device, by colliding the plurality of impact surfaces together using energy generated from an application of a tensile force to the jarring assembly by the non-rigid conveyance device, the at least one impact load resulting in at least a shock wave inducing i) translational motion along the longitudinal axis of the tool string, and ii) motion in at least one other degree of freedom sufficient to alleviate the stuck condition of the tool string.

2. The method of claim 1 wherein the motion in the at least one other degree of freedom comprises at least one of: i) translational motion along an axis substantially normal to the longitudinal axis, and ii) rotational motion.

3. The method of claim 1, wherein at least one of the plurality of impact surfaces is asymmetric about the longitudinal axis.

4. The method of claim 1, further comprising:

releasing a mechanical constraint in response to activation of the jarring assembly to cause movement of a first impact surface of the jarring assembly to collide with a second impact surface of the jarring assembly to apply the at least one impact load.

5. The method of claim 1, further comprising:

operating a hydraulic mechanism in response to activation of the jarring assembly to cause movement of a first impact surface of the jarring assembly to collide with a second impact surface of the jarring assembly to apply the impact load.

6. The method of claim 1, wherein the at least one impact load comprises a first load component normal to the longitudinal axis and a second load component non-normal to the longitudinal axis, the method comprising using the jarring assembly to impart the load component normal to the longitudinal axis with a first set of impact surfaces of the plurality of impact surfaces and using the jarring assembly to impart the non-normal component of the at least one impact load with a second set of impact surfaces of the plurality of impact surfaces.

7. The method of claim 6, comprising imparting the normal component at a different time than the non-normal component.

8. The method of claim 6, comprising imparting the normal component substantially simultaneously as the non-normal component.

9. The method of claim 6, comprising imparting the normal component at the same axial depth on the tool as the non-normal component.

10. The method of claim 6, comprising imparting the normal component at a different axial depth on the tool than the non-normal component.

11. The method of claim 1, comprising imparting a plurality of impact loads on the tool, wherein a first impact load of the plurality of impact loads is at a different axial depth on the tool than a second impact load of the plurality of impact loads.

12. The method of claim 1, wherein the at least one impact load is further configured to generate at least one of: i) a component of rotation about the longitudinal axis; and ii) a component of rotation normal to the axis.

13. The method of claim 1, wherein the at least one impact load is configured to overcome a force normal to the borehole wall resulting from a pressure differential between the borehole and the earth formation.

14. The method of claim 1, wherein the jarring assembly further comprises:

an axially traveling member with a first impact surface of the plurality of impact surfaces connected operatively thereto;

a second impact surface of the plurality of impact surfaces positioned on another member at an axial distance from the first impact surface;

a biasing member urging the axially traveling member to an impact location wherein the first impact surface meets the second impact surface; and a constraint configured to prevent travel of the axially traveling member to the impact location prior to triggering, the constraint further configured to suddenly allow the axially traveling member to freely accelerate toward the impact location upon triggering until the first impact surface and the second impact surface collide;

wherein the first impact surface and the second impact surface are oriented to generate the impact load upon collision.

15. The method of claim 14, wherein a path of travel of the first impact surface after triggering is helical.

16. The method of claim 14, wherein the constraint is triggered by tensioning the biasing member past a threshold tension, and further comprising modifying the threshold tension while the tool is downhole.

17. The method of claim 1, wherein the at least one impact load comprises a plurality of impact loads, and wherein the jarring assembly is configured to automatically impart the plurality of impact loads in sequence.

18. The method of claim 1 further comprising using information from a sensor incorporated in the tool estimate at least one of: i) a jarring parameter, ii) a drilling parameter, iii) a borehole property; and iv) a property of the earth formation.

19. The method of claim 1 further comprising triggering a mechanical release to cause the colliding.

20. The method of claim 1 further comprising causing the colliding via the application of tension on the non-rigid conveyance device.

21. The method of claim 1 wherein the energy generated from the application of the tensile force results from a release of potential energy stored from the application of the tensile force.

22. The method of claim 21 further comprising triggering the release with the application of the tensile force.

23. The method of claim 21 wherein colliding the plurality of impact surfaces together using the energy generated from the application of the tensile force to the jarring assembly by the non-rigid conveyance device comprises moving at least one impact surface of the plurality of impact surfaces axially by the application of the tensile force.

* * * * *